US006698352B2

(12) United States Patent
Fujiwara et al.

(10) Patent No.: US 6,698,352 B2
(45) Date of Patent: Mar. 2, 2004

(54) INKING APPARATUS CONTROL MEANS FOR ROTARY PRESS

(75) Inventors: Masaomi Fujiwara, Toride (JP); Syuji Fukushima, Toride (JP)

(73) Assignee: Komori Corporation, Tokyo (JP)

( * ) Notice: Subject to any disclaimer, the term of this patent is extended or adjusted under 35 U.S.C. 154(b) by 23 days.

(21) Appl. No.: 09/893,649

(22) Filed: Jun. 29, 2001

(65) Prior Publication Data

US 2002/0014172 A1 Feb. 7, 2002

(30) Foreign Application Priority Data

Jun. 30, 2000 (JP) ..... 2000-197726

(51) Int. Cl.[7] ..... B41F 31/00
(52) U.S. Cl. ..... 101/349.1; 101/351.1
(58) Field of Search ..... 101/349.1, 351.1, 101/350, DIG. 38, 328, 329, 352.06, 352.07, 352.09

(56) References Cited

U.S. PATENT DOCUMENTS

| | | | | |
|---|---|---|---|---|
| 2,366,199 A | | 1/1945 | Kunz | 74/96 |
| 4,513,663 A | * | 4/1985 | Hummel et al. | 101/350.3 |
| 5,186,100 A | * | 2/1993 | Turturro et al. | 101/40 |
| 5,701,817 A | * | 12/1997 | Thunker et al. | 101/350.1 |
| 5,713,280 A | * | 2/1998 | Kelm et al. | 101/142 |
| 5,819,656 A | * | 10/1998 | Gertsch et al. | 101/352.09 |
| 6,109,181 A | * | 8/2000 | Kamoda | 101/477 |
| 6,354,202 B1 | * | 3/2002 | Heiler | 101/148 |

FOREIGN PATENT DOCUMENTS

| | | |
|---|---|---|
| DE | 8233057 U | 3/1986 |
| JP | 63-170138 U | 11/1988 |
| JP | 63-264352 A | 11/1988 |
| JP | 63-315244 A | 12/1988 |

* cited by examiner

*Primary Examiner*—Anthony H. Nguyen
(74) *Attorney, Agent, or Firm*—Birch, Stewart, Kolasch & Birch, LLP

(57) ABSTRACT

An inking apparatus controller includes an oscillating roller rotatable in a circumferential direction and reciprocatable along an axial direction thereof; an oscillation-width adjustment mechanism for adjusting an oscillation width of the oscillating roller; an oscillation-width adjustment unit for operating the oscillation-width adjustment mechanism; and a control unit for controlling operation of the oscillation-width adjustment unit such that the oscillation width of the oscillating roller assumes a designated value and for controlling operation of the oscillation-width adjustment means such that during cleaning work, the oscillating roller oscillates over an oscillation width which is set in a memory in advance.

18 Claims, 14 Drawing Sheets

INKING APPARATUS CONTROL MEANS FOR ROTARY PRESS

The entire disclosure of Japanese Patent Application No. 2000-197726 filed on Jun. 30, 2000, including specification, claims, drawings, and summary is incorporated herein by reference in its entirety.

BACKGROUND OF THE INVENTION

1. Field of the Invention

The present invention relates to an inking apparatus control means for a rotary press, and more particularly, to a mechanism for automatically modifying the conditions for operating an oscillating roller when cleaning an ink supply apparatus.

2. Description of the Related Art

An ink supply apparatus of a printing press for supplying ink to a surface of a plate attached to a plate cylinder comprises an ink fountain for storing ink, and a group of rollers for transferring ink from the ink fountain while uniformly distributing the ink in respective directions. The ink transferred to the end portion of the group of rollers is supplied to the plate cylinder via an ink form roller.

In general, such an ink supply apparatus (hereinafter referred to as an "inker") for effecting an ink supply operation employs a drive system such that the ink supply apparatus is mechanically connected to a driving side (main unit), which includes a plate cylinder and which rotates the plate cylinder, to thereby receive rotational torque from the driving side.

Further, for a short-time operation such as operation for printing preparation or operation for maintenance and cleaning of the inker, there has been developed a system for breaking a mechanical connection between the inker and the driving side by means of a clutch and for rotating the inker independently of the main unit by means of a separate drive source (motor) (Japanese Patent Application Laid-Open (kokai) No. 63-315244).

Meanwhile, when a rainbow printing is to be performed for preventing forgery, an oscillation apparatus is built into the inker in order to adjust oscillation conditions such as an oscillation width of an oscillating roller and the number of times of oscillation strokes.

A known oscillation apparatus is of a hydraulic-control-type, in which ink stored in the ink fountain is supplied to the oscillating roller, and the oscillating roller is reciprocated along an axial direction thereof by means of a hydraulic cylinder, whereby the ink is supplied to the plate cylinder while being spread in the axial direction of the oscillating roller (see, for example, Japanese Patent Application Laid-Open (kokai) No. 63-264352 and Japanese Utility Model Application Laid-Open (kokai) No. 63-170138).

When the above-described inker is to be cleaned, the inker is mechanically disengaged from the main unit, and the group of rollers and the oscillating roller are rotated, while cleaning solution is jetted from cleaning nozzles toward the group of rollers. Such cleaning work has been performed while the oscillation width and the number of times of oscillations of the oscillating roller set for an ordinary printing are maintained.

In order to effectively perform the cleaning of the inker, the preset oscillation width can be changed to increase the oscillation width of the oscillating roller. However, in this case, the oscillation width of the oscillating roller must be reset to the original value after completion of the cleaning.

Therefore, in actuality, cleaning has generally been performed with the oscillation width of the oscillating roller being maintained.

Therefore, cleaning of the group of rollers of the inker, as generally performed, was not always efficient.

Notably, since the oscillation speed is maintained constant during an ordinary printing, the oscillation speed has been difficult to change during cleaning.

SUMMARY OF THE INVENTION

In view of the foregoing, an object of the present invention is to provide inking apparatus control means, which can automatically change conditions for operating an oscillating roller when a group of rollers of an inker are cleaned and which can automatically restore the original conditions after completion of the cleaning.

Another object of the present invention is to complete cleaning of the ink unit within a short period of time.

In order to achieve the above objects, the present invention provides an inking apparatus control means for a rotary press, comprising an oscillating roller rotatable in a circumferential direction and reciprocatable along an axial direction thereof; and control means for controlling at least one of an oscillation width of the oscillating roller and a number of times of oscillations (i.e., oscillation speed) of the oscillating roller relative to a number of revolutions (i.e., rotational speed) of a plate cylinder, wherein at least one of the oscillation width of the oscillating roller and the number of times of oscillations of the oscillating roller relative to the number of revolutions of the plate cylinder assumes a designated value such that during a cleaning work, at least one of the oscillation width of the oscillating roller and the number of times of oscillations of the oscillating roller relative to the number of revolutions of the plate cylinder assume a predetermined value.

Preferably, the inking apparatus control means further comprises an oscillation-width adjustment mechanism for adjusting an oscillation width of the oscillating roller; and oscillation-width adjustment means for operating the oscillation-width adjustment mechanism, wherein the control means controls operation of the oscillation-width adjustment means such that the oscillation width of the oscillating roller assumes a designated value such that the oscillating roller oscillates over a preset oscillation width during the cleaning work.

Preferably, the inking apparatus control means further comprises an oscillation mechanism for reciprocating the oscillating roller; and oscillation-mechanism drive means for operating the oscillation mechanism, wherein the control means controls operation of the oscillation-mechanism drive means, on the basis of the number of revolutions of the plate cylinder, such that the number of times of oscillations of the oscillating roller relative to the number of revolutions of the plate cylinder assumes a designated value and such that the number of times of oscillations of the oscillating roller assume a predetermined value during the cleaning work.

Preferably, the control means rotates the oscillating roller at a preset number of revolutions (rotational speed) In this case, the oscillation mechanism drive means preferably rotates the oscillating roller at least during a cleaning work.

Preferably, the inking apparatus control means further comprises a clutch for permitting and stopping transmission of rotation from the oscillation mechanism drive means to the oscillating roller. More preferably, the inking apparatus control means further comprises a main motor for rotating the plate cylinder and the oscillating roller; and connecting/disconnecting means for stopping and permitting transmission of rotation from the main motor to the oscillating roller, wherein the clutch is brought into connected and disconnected states in such a manner that a transmission of rotation from the oscillation-mechanism drive means to the oscillating roller is stopped when rotation is transmitted from the main motor to the oscillating roller by the connecting/disconnecting means and that rotation is transmitted from the oscillation-mechanism drive means to the oscillating roller when transmission of rotation from the main motor to the oscillating roller is stopped by the connecting/disconnecting means.

Preferably, the inking apparatus control means further comprises a switch for starting the cleaning work, wherein in response to an operation of the switch, the control means control the oscillation-width adjustment means such that the oscillating roller oscillates over a preset oscillation width.

Preferably, the inking apparatus control means further comprises a switch for starting the cleaning work, wherein in response to an operation of the switch, the control means controls the oscillation-mechanism drive means such that the number of times of oscillations of the oscillating roller assumes a preset value.

Preferably, the inking apparatus control means further comprises a cleaning apparatus for cleaning the oscillating roller and a distribution roller supported rotatably in a circumferential direction and unmovable in an axial direction; setting means for setting conditions such that at least one of the oscillation width and the number of times of oscillations of the oscillating roller increases at the beginning of the cleaning; and a memory for storing at least one of a set value for the oscillation width and a set value for the number of times of oscillations of the oscillating roller, which set value is used before the setting is performed by setting means, wherein upon completion of the cleaning, the set value is read from the memory, and one of the oscillation width and the number of times of oscillations are reset to the original values used before the cleaning. In this case, preferably, the setting means sets one of the oscillation width and the number of times of oscillations of the oscillating roller to a maximum value; and/or the control means causes the oscillation-mechanism drive means to operate at a higher speed.

Preferably, the cleaning work is performed in a space formed as a result of separating a first frame which supports the cylinder and a second frame which supports the oscillating roller.

Preferably, the inking apparatus control means further comprises an oscillation mechanism for reciprocating the oscillating roller; an oscillation-mechanism drive means for operating the oscillation mechanism; an oscillation-width adjustment mechanism for adjusting an oscillation width of the oscillating roller; and oscillation-width adjustment means for operating the oscillation-width adjustment mechanism.

Preferably, the oscillation mechanism includes a swing member which swings upon operation of the oscillation-mechanism drive means, a moving member movably supported on the swing member, and an engagement member rotatably supported on the moving member and being in engagement with the oscillating roller; and the oscillation-width adjustment mechanism is configured such that, upon operation of the oscillation-width adjustment means, the oscillation-width adjustment mechanism moves the moving member to thereby adjust a distance between a swing center of the swing member and a rotation center of the engagement member. In this case, preferably, the moving member is slidably supported on the swing member.

Preferably, the oscillation mechanism includes a crank mechanism whose input side is connected to the oscillation-mechanism drive means, a swingably-supported swing lever whose base end side is connected to the output side of the crank mechanism, a slide lever slidably supported by the swing lever such that a distal end side of the slide lever can move toward and away from a swing center of the swing lever, a first link plate whose one end side is rotatably supported by the distal end side of the slide lever, a swingably-supported swing plate, the other end side of the first link plate being rotatably connected to the base end side of the swing plate, and a cam follower provided at the distal end side of the swing plate and inserted into a groove wheel of the oscillating roller; and the oscillation-width adjustment mechanism includes a worm gear connected to the oscillation-width adjustment means, a worm wheel in meshing engagement with the worm gear, a transmission shaft coaxially connected to the worm wheel, a second link plate whose one end side is connected to the transmission shaft, and the slide lever whose base end side is rotatably connected to the other end side of the second link plate.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

A preferred embodiment in which the present invention is applied to a double-sided, multicolor offset press will be described with reference to FIGS. 1A to 10.

Figure 1A:
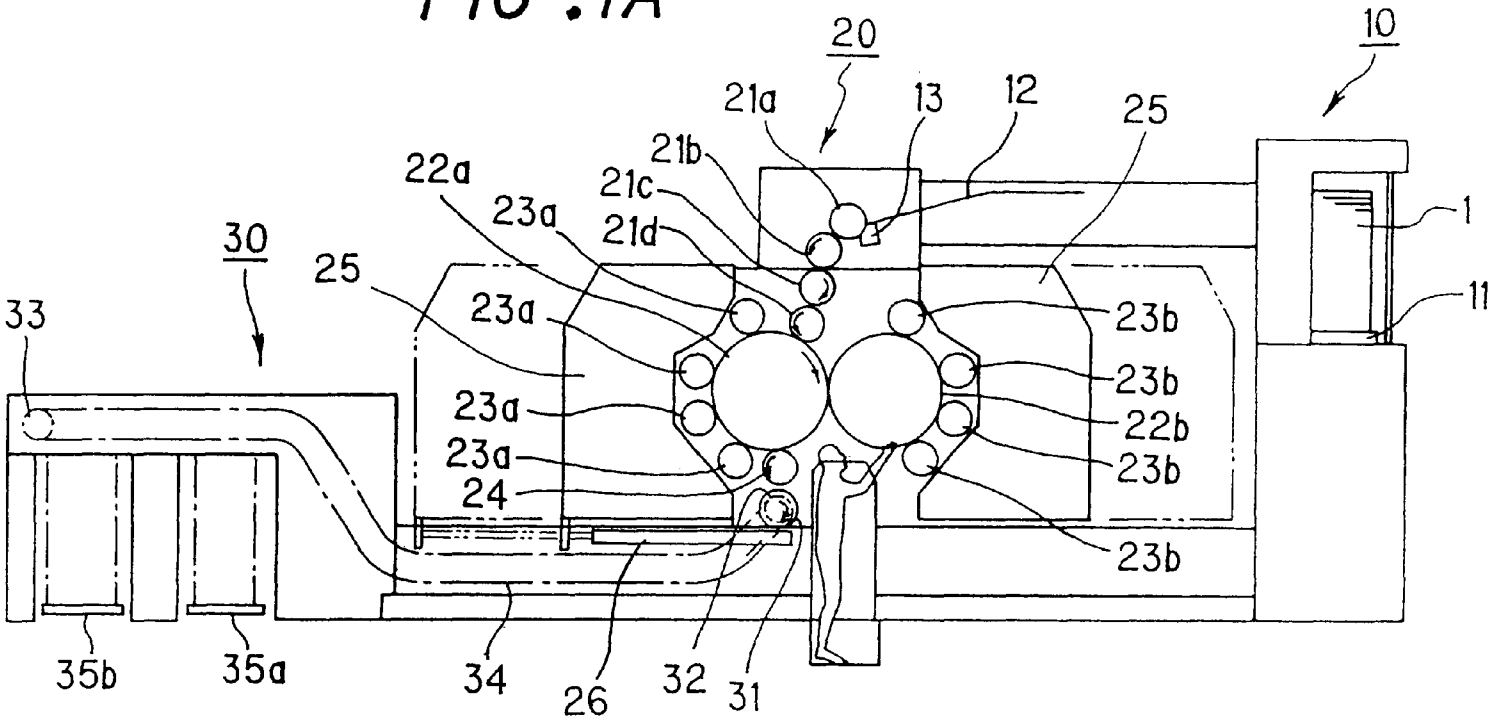
FIG. 1A is a view schematically showing a overall structure of a preferred embodiment in which the present invention is applied to an inker of an ink supply apparatus of a double-sided, multicolor offset press.

As shown in FIG. 1A, a sheet-feed table 11 is disposed within a feeder unit 10.

A feeder board 12 is provided in the feeder unit 10. The feeder board 12 feeds paper sheets 1 from the sheet-feed table 11 to a printing unit 20 one sheet at a time.

A swing apparatus 13 for transferring the paper sheets 1 to a transfer cylinder 21*a* of the printing unit 20 is provided at the distal end of the feeder board 12.

The transfer cylinder 21*a* is in contact with an impression cylinder 22*a* via transfer cylinders 21*b* to 21*d*. A blanket made of rubber is attached to the outer circumferential surface of the impression cylinder 22*a*.

A rubber cylinder 22*b* is in contact with the impression cylinder 22*a* at a position downstream of the transfer cylinder 21*d*.

A plurality of (four in the present embodiment) plate cylinders 23*a* are in contact with the impression cylinder 22*a* at positions upstream of the transfer cylinder 21*d* in such a manner that the plate cylinders 23*a* are arranged along the circumferential direction at predetermined intervals.

A plurality of (four in the present embodiment) plate cylinders 23*b* are in contact with the rubber cylinder 22*b* at positions upstream of the impression cylinder 22*a* in such a manner that the plate cylinders 23*b* are arranged along the circumferential direction at predetermined intervals.

A transfer cylinder 24 is in contact with the impression cylinder 22*a* at a position downstream of the rubber cylinder 22*b*.

A delivery cylinder 31 of a delivery unit 30 is in contact with the transfer cylinder 24. A sprocket 32 is coaxially fixed to the delivery cylinder 31.

Further, a sprocket 33 is provided in a delivery unit 30.

A delivery chain 34 is extended between and wound around the sprockets 32 and 33.

A plurality of delivery grippers (not shown) are provided on the delivery chain 34 at predetermined intervals.

Delivery tables 35*a* and 35*b*, on which printed paper sheets 100 are placed are provided in the delivery unit 30.

Figure 2:
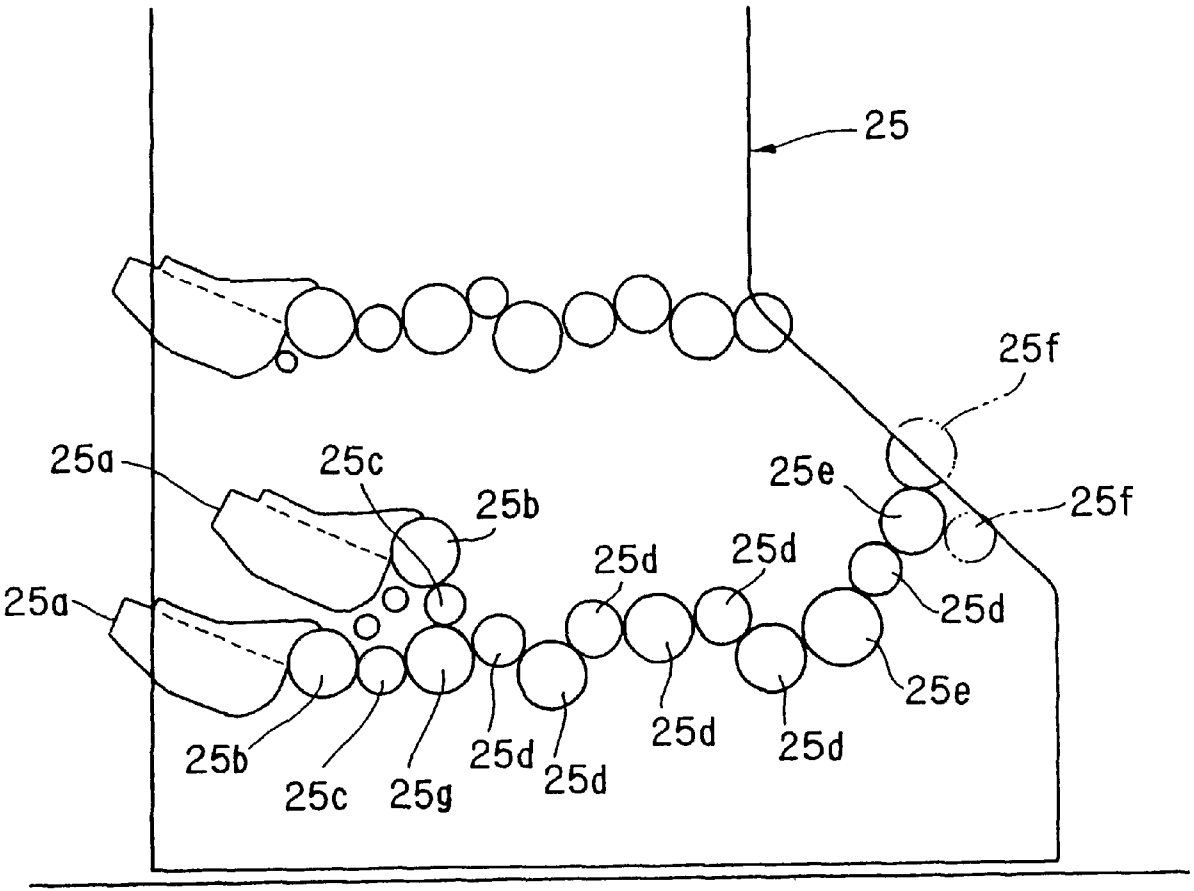
FIG. 2 is an enlarged view of the inker portion.
Figure 3:
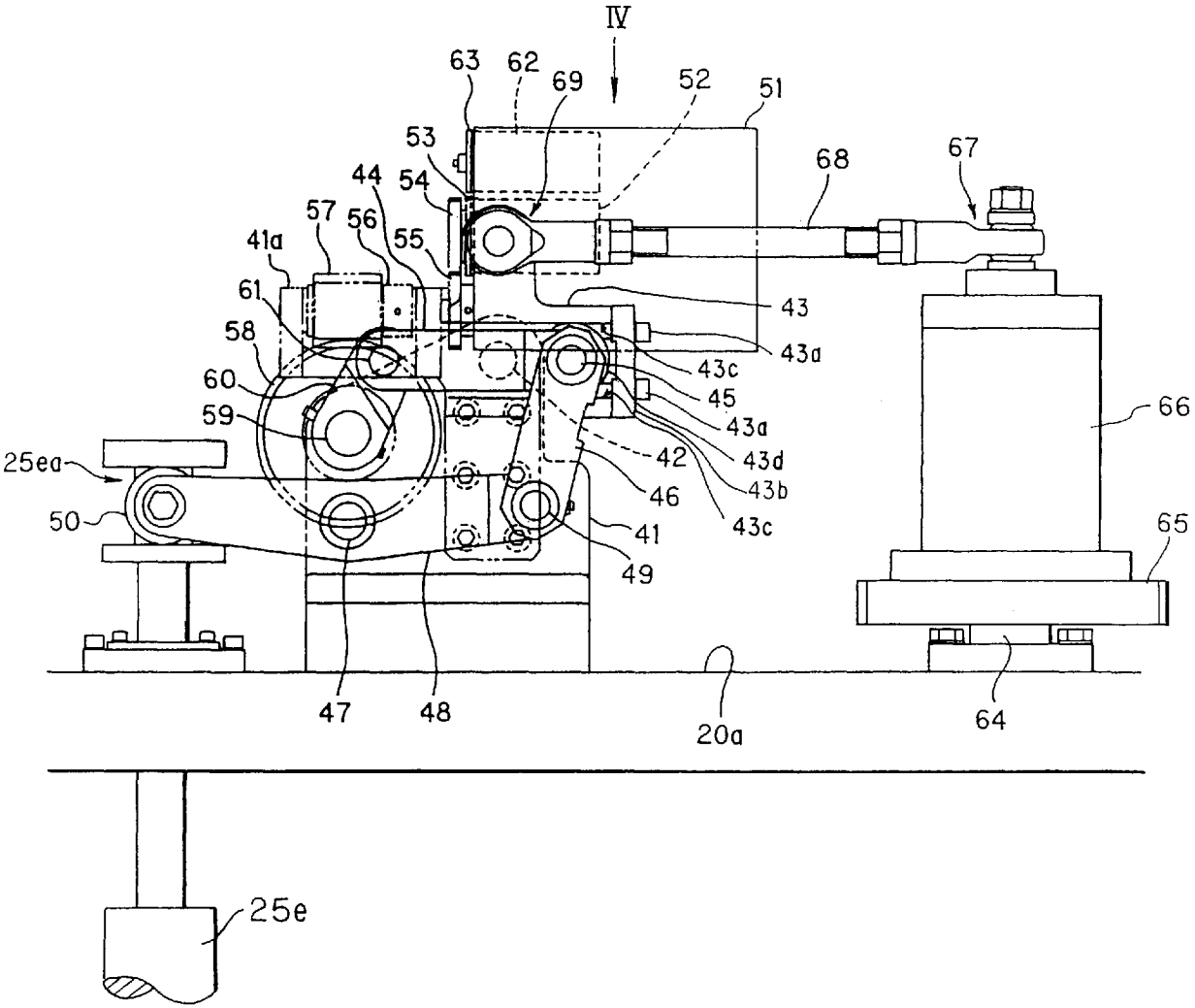
FIG. 3 is a side sectional view schematically showing the structure of a main portion of the oscillating roller oscillation apparatus.
Figure 4:
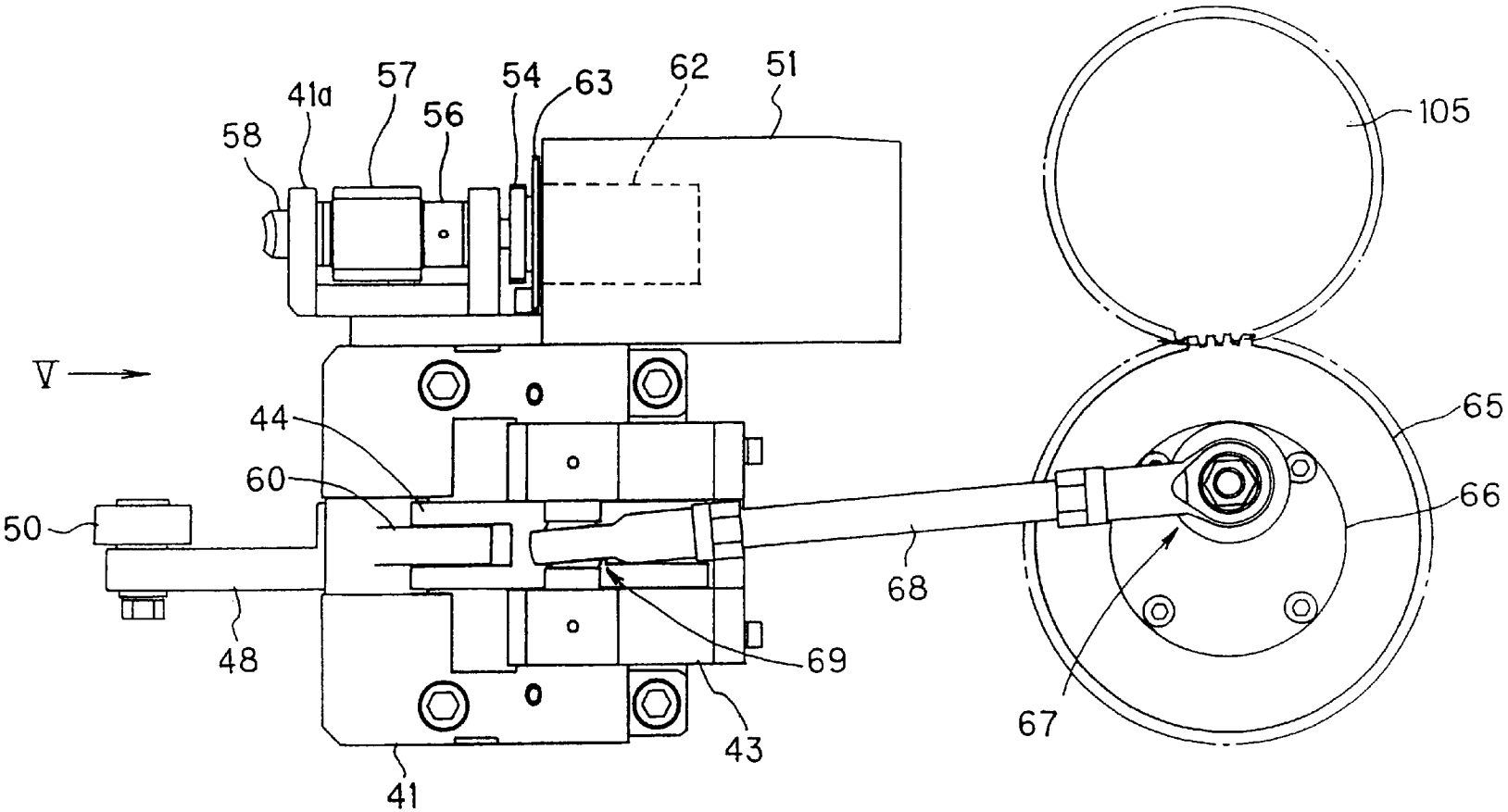
FIG. 4 is a plan view as viewed from the direction of arrow IV in FIG. 3.
Figure 5:
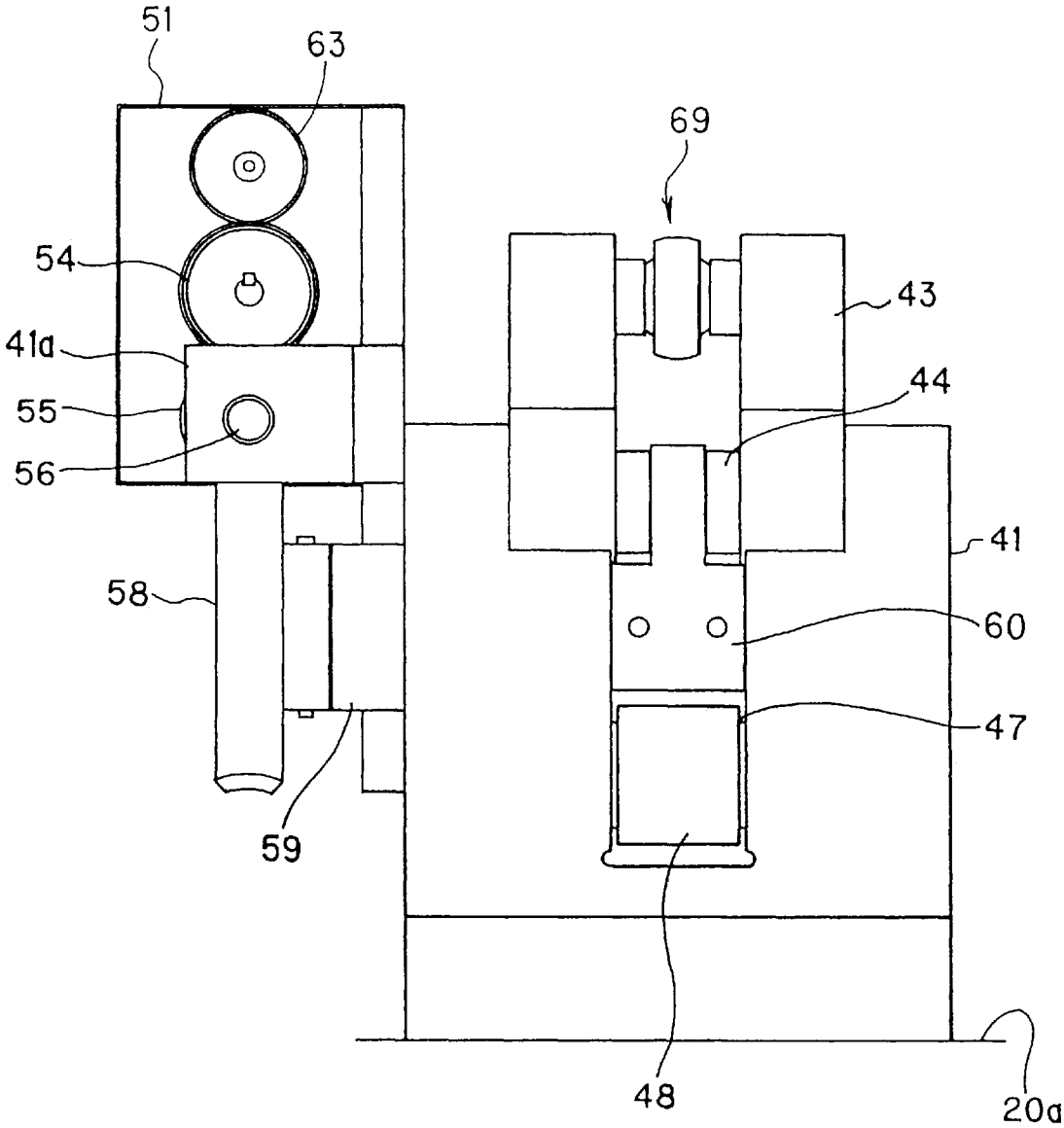
FIG. 5 is a front view as viewed from the direction of arrow V in FIG. 4.
Figure 6:
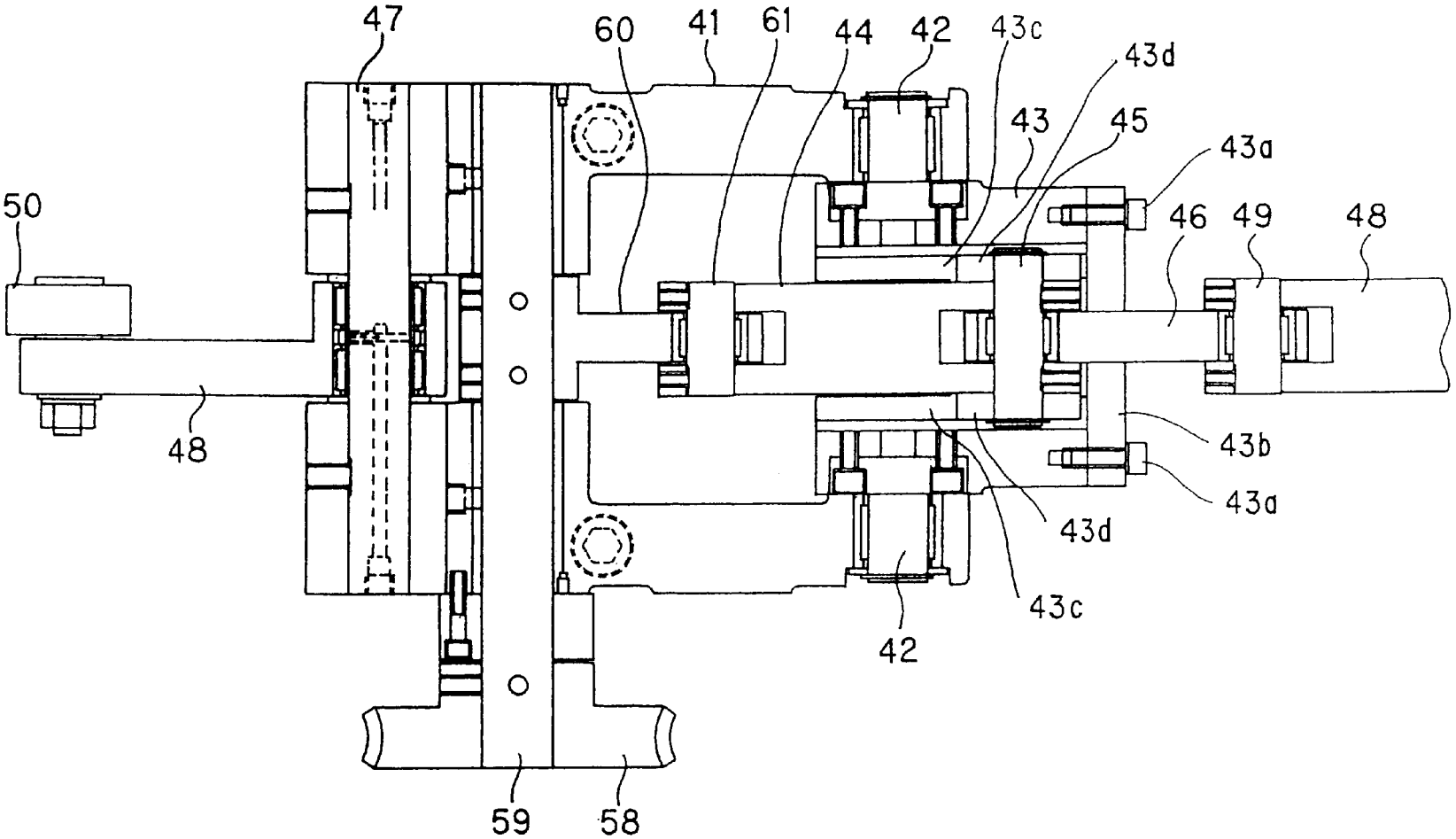
FIG. 6 is a horizontally-sectioned development view of a main portion of FIG. 3.

As shown in FIG. 2, an inker 25 for supplying ink is provided for each of the plate cylinders 23*a*.

The inker 25 includes ink fountains 25*a* for holding ink; fountain rollers 25*b* for feeding ink from the ink fountains 25*a*; ductor rollers 25*c* for drawing the ink fed by the fountain rollers 25*b*; distribution rollers 25*d* for kneading the drawn ink; oscillating rollers 25*e* for spreading the ink in the axial direction through reciprocating movement along the axial direction; form rollers 25*f* for supplying the ink to the corresponding plate cylinder 23*a*; and a drive roller 25*g* for rotating these rollers 25*b* to 25*f* in an interlocked manner.

Further, an inker 25 having a similar structure is provided for each of the above-described plate cylinders 23*b*.

Moreover, a hydraulic cylinder 26 serving as frame moving means (not shown) is provided in the inker 25. The hydraulic cylinder 26 is used to move the inker 25 from a position indicated by a solid line to a position indicated by a two-dot chain line as shown in FIGS. 1A and 1B.

When the inker 25 is moved to the position indicated by the two-dot chain line in FIG. 1A, the inker 25 separates from the impression cylinder 22*a* and the plate cylinders 23*a*, so that the inker 25 is mechanically disengaged from the main unit, as will be described later.

Figure 1B:
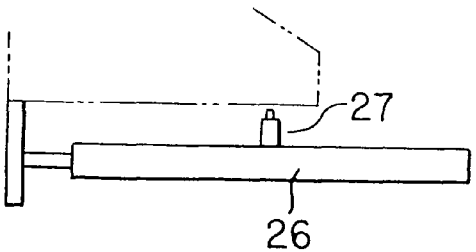
FIG. 1B is an enlarged view of a hydraulic cylinder.
Figure 12:
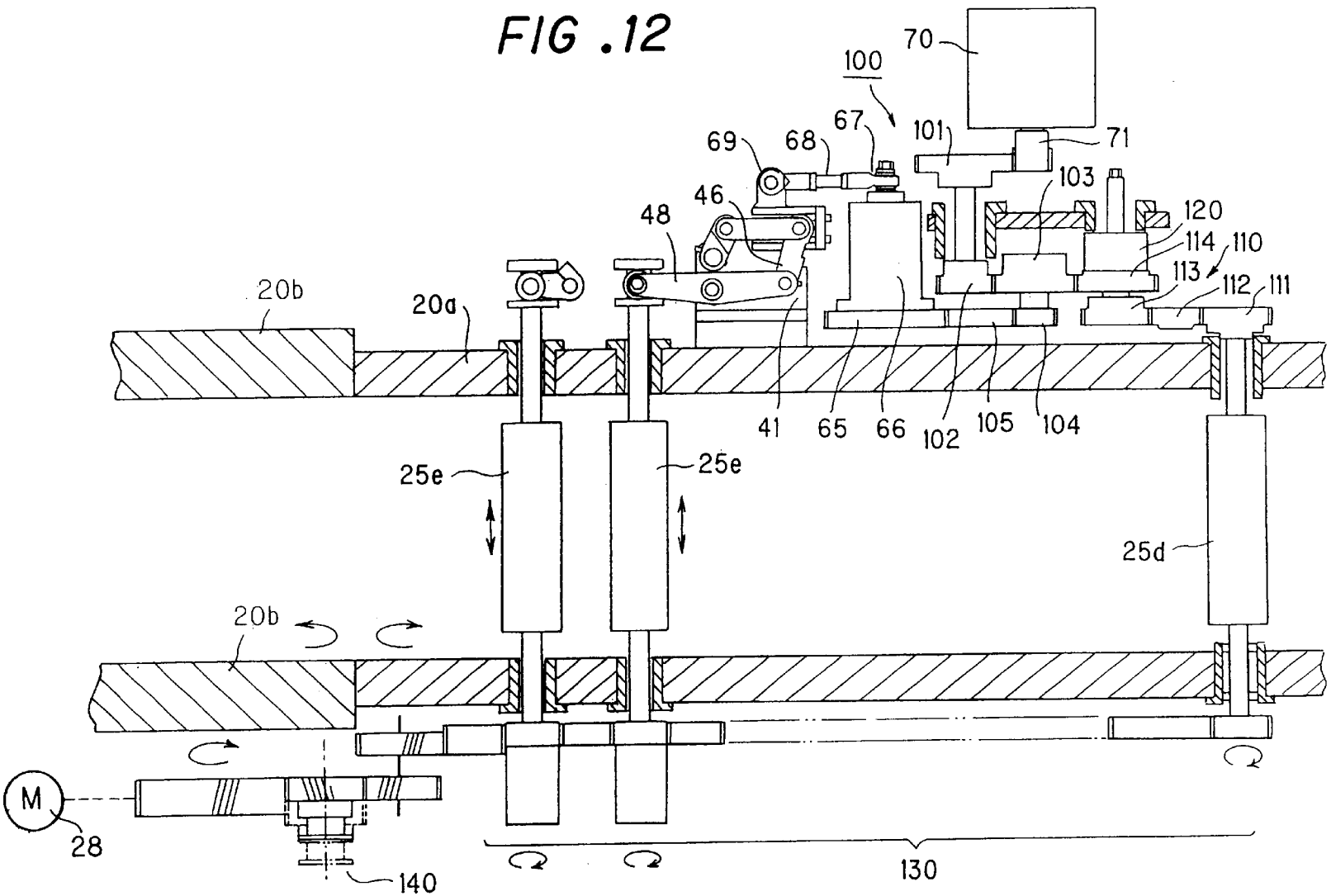
FIG. 12 is a schematic view showing the structure of a drive force transmission mechanism of the inker.

A sensor 27 for detecting the inker frame 20*a* is supported above the hydraulic cylinder 26 as shown in FIG. 1B. The present embodiment is configured such that an electromagnetic clutch 120, as shown in FIG. 12, can be turned ON when the sensor 27 becomes impossible to detect the inker frame 20*a*, and the electromagnetic clutch 120 cannot be turned ON when the sensor 27 detects the inker frame 20*a*.

That is, the clutch 120 cannot be turned ON when the inker frame 20*a* and a main unit frame 20*b* are in proximity to each other.

As shown in FIGS. 3–6, a support base 41 is attached to an inker frame 20*a* of the printing unit 20 to be located in the vicinity of a shaft end portion of the oscillating roller 25*e*.

A pair of L-shaped swing levers 43 are provided on the support base 41. The bent center portion of each swing lever 43, located between the distal end and base end thereof, is pivotaly supported by a support pin 42 such that the swing lever 43 can swing in a direction toward and away from the oscillating roller 25*e*.

The swing levers 43 are connected together by a plate 43*b* and bolts 43*a*.

A slide groove 43*c* is formed on each swing lever 43 to be located between the distal end and the bent center portion thereof.

A block 43*d* is slidably attached to the slide groove 43*c* of each swing lever 43.

The block 43*d* is supported by the corresponding end portion of a pin 45.

The distal end portion of a slide lever 44 and a first end portion of a first link plate 46 are rotatably connected to the pin 45.

In other words, the distal end portion of the slide lever 44 and the first end portion of the first link plate 46 are supported by the swing levers 43 via the pin 45 and the blocks 43*d* such that they can move toward and away from the support pin 42.

The base end portion of a swing plate 48 is rotatably connected to a second end portion of the first link plate 46 via a pin 49. A portion of the swing plate 48 located between the distal end and base end thereof is pivotally supported on the support base 41 via a support pin 47.

A cam follower 50 is attached to the distal end portion of the swing plate 48.

The cam follower 50 is inserted into a groove wheel 25*ea* provided at the shaft end portion of the above-described oscillating roller 25*e*.

The shaft end portion of the oscillating roller 25*e* is slidably supported such that the oscillating roller 25*e* can reciprocate in the axial direction thereof.

Meanwhile, a casing 51 is attached to the support base 41. The casing 51 includes an oscillation-width adjustment motor 52 which can be rotated in regular and reverse directions and is equipped with a brake.

A gear 53 and a drive gear 54 are coaxially attached to the drive shaft of the motor 52.

The drive gear 54 is in meshing engagement with a transmission gear 55 rotatably supported on the casing 51.

One end portion of a drive shaft 56, which is rotatably supported on the support base 41 via a bracket 41*a*, is coaxially connected to the transmission gear 55.

A worm gear 57 is coaxially attached to the drive shaft 56.

A worm wheel 58, which is rotatably supported on the support base 41, is in meshing engagement with the worm gear 57.

A transmission shaft 59 is rotatably supported on the support base 41, and one end portion of the transmission shaft 59 is coaxially connected to the worm wheel 58.

One end portion of a second link plate 60 is fixedly connected to the transmission shaft 59.

The other end portion of the second link plate 60 is rotatably connected to the base end portion of the slide lever 44 via a pin 61.

That is, when the motor 52 is driven, the slide lever 44 is moved via the drive gear 54, the transmission gear 55, the drive shaft 56, the worm gear 57, the worm wheel 58, the transmission shaft 59, the second link plate 60, and the pin 61, so that the slide lever 44 slides along the slide groove 43*c* of the swing lever 43 together with the pin 45 and the block 43*d*. As a result, the pin 45, serving as the center of swinging motion of the first link plate 46, can be brought closer to and further away from the support pin 42 serving as the center of swing motion of the swing levers 43. Thus, the distance between the pins 42 and 45 can be adjusted.

A potentiometer 62 is provided within the casing 51.

A gear 63 is coaxially attached to the input shaft of the potentiometer 62 and is in meshing engagement with the gear 53.

Therefore, when the motor 52 is driven, the gear 53 rotates, and the rotational amount of the gear 53 is detected by the potentiometer 62 via the gear 63. Thus, the distance between the pins 42 and 45 can be detected.

On the inker frame 20*a*, the base end portion of a support shaft 64 is supported in a cantilever manner in the vicinity of the support base 41 such that the axis of the support shaft 64 becomes parallel to the axis of the oscillating roller 25*e*.

A transmission gear 65 is coaxially attached to the support shaft 64 at a position near the inker frame 20*a*.

A rotary drum 66 is coaxially attached to the distal end portion of the support shaft 64.

A universal joint 67 is attached to one end surface of the rotary drum 66 to be offset with respect to the center axis of the rotary drum 66.

The base end portion of a shaft 68 is connected to the universal joint 67.

The distal end portion of the shaft 68 is connected to the base ends of the swing levers 43 via a universal joint 69.

Further, as shown in FIG. 12, the transmission gear 65 is in meshing engagement with a drive gear 71 of an oscillation-mechanism drive motor 70 via a gear train 100.

Specifically, the oscillation-mechanism drive motor 70 is fixedly supported on the inker frame 20*a*, and the drive gear 71 of the motor 70 is in meshing engagement with an intermediate gear 101. An intermediate gear 102, which is coaxial and integral with the intermediate gear 101, is in meshing engagement with an intermediate gear 103. Further, an intermediate gear 104, which is coaxial and integral with the intermediate gear 103, is in meshing engagement with the transmission gear 65 via an intermediate gear 105.

Therefore, when the drive gear 71 is rotated through operation of the oscillation-mechanism drive motor 70, the rotary drum 66 is rotated via the intermediate gears 101 to 105, the transmission gear 65, and the support shaft 64. As the rotary drum 66 rotates, the universal joint 67 revolves, and consequently, the shaft 68 reciprocates along its axial direction. This reciprocating motion of the shaft 68 is transmitted to the base ends of the swing levers 43 via the universal joint 69, so that the distal ends of the swing levers 43 can be swung about the support pin 42.

Moreover, as shown in FIG. 12, a gear train 110 and an electromagnetic clutch (tooth clutch) 120 are disposed between the intermediate gear 103 and the distribution roller 25*d*.

Specifically, similar to the case of the oscillating rollers 25*e*, the distribution roller 25*d* is rotatably supported on the inker frame 20*a*. A transmission gear 111 is attached to one end of the distribution roller 25*d*, and is in meshing engagement with one coupling gear 113 of the electromagnetic clutch 120 via an intermediate gear 112.

In addition to the coupling gear 113, the electromagnetic clutch 120 has a coupling gear 114, which is coaxial with the coupling gear 113. The coupling gear 114 is in meshing engagement with the intermediate gear 103.

When electricity is supplied to the electromagnetic clutch 120, the coupling gear 113 and the coupling gear 114 are united by means of electromagnetic attraction force. When no electricity is supplied to the electromagnetic clutch 120, the coupling gear 113 and the coupling gear 114 can rotate freely.

Therefore, when the oscillation-mechanism drive motor 70 is operated in a state in which electricity is supplied to the electromagnetic clutch 120, its rotation is transmitted to the distribution roller 25*d* via the gear trains 100 and 110.

The electromagnetic clutch 120 is controlled by a control apparatus such that the electromagnetic clutch 120 comes into an engaged state only when the inker 25 is driven solely, and comes into an disengaged state during ordinary printing.

Further, as shown in FIG. 12, the other ends of the distribution roller 25*d* and the plurality of oscillating rollers 25*e* are mutually coupled through a gear train 130 and are connected with the main unit via a clutch 140 (in FIG. 12, a portion of the gear train 130 is omitted for simplification).

The clutch 140 is in an engaged state at all times, except the case in which the number of colors to be printed is small.

Accordingly, as shown in FIG. 12, the drive force from a drive motor 28 of the main unit, serving as the first motor, is transmitted to the oscillating rollers 25*e* and the distribution roller 25*d* via the clutch 140 and the gear train 130, so that these rollers 25*e* and 25*d* rotate.

When the inker 25 is moved to the position indicated by the two-dot chain line in FIG. 1A by means of the hydraulic cylinder 26, the inker frame 20*a*, which supports the distribution roller 25*d* and the oscillating rollers 25*e* separates from a main unit frame 20*b*, which supports the impression cylinder 22*a* and the plate cylinders 23*a*, as shown in FIG. 12. Consequently, the engagement between the gear train 130 of the inker 25 and the clutch 140 of the main unit is broken to establish a state in which the main unit and the inker 25 can be driven independently of each other.

The hydraulic cylinder 26 for moving the inker 25 is controlled by an unillustrated control apparatus in such a manner that the inker 25 is positioned at the position indicated by the two-dot chain line in FIG. 1A only when the inker 25 is driven solely and that, during ordinary printing, the inker 25 is positioned at the position indicated by the solid line in FIG. 1A where the form rollers 25*f* come into contract with the plate cylinders 23*a*.

The hydraulic cylinder 26 serves as connecting/disconnecting means for separating the main unit and the inker 25 from each other and for connecting the main unit and the inker 25 to each other. Therefore, instead of moving the inker frame 20*a*, the main unit frame 20*b* may be moved, insofar as such a function is achieved.

Figure 7:
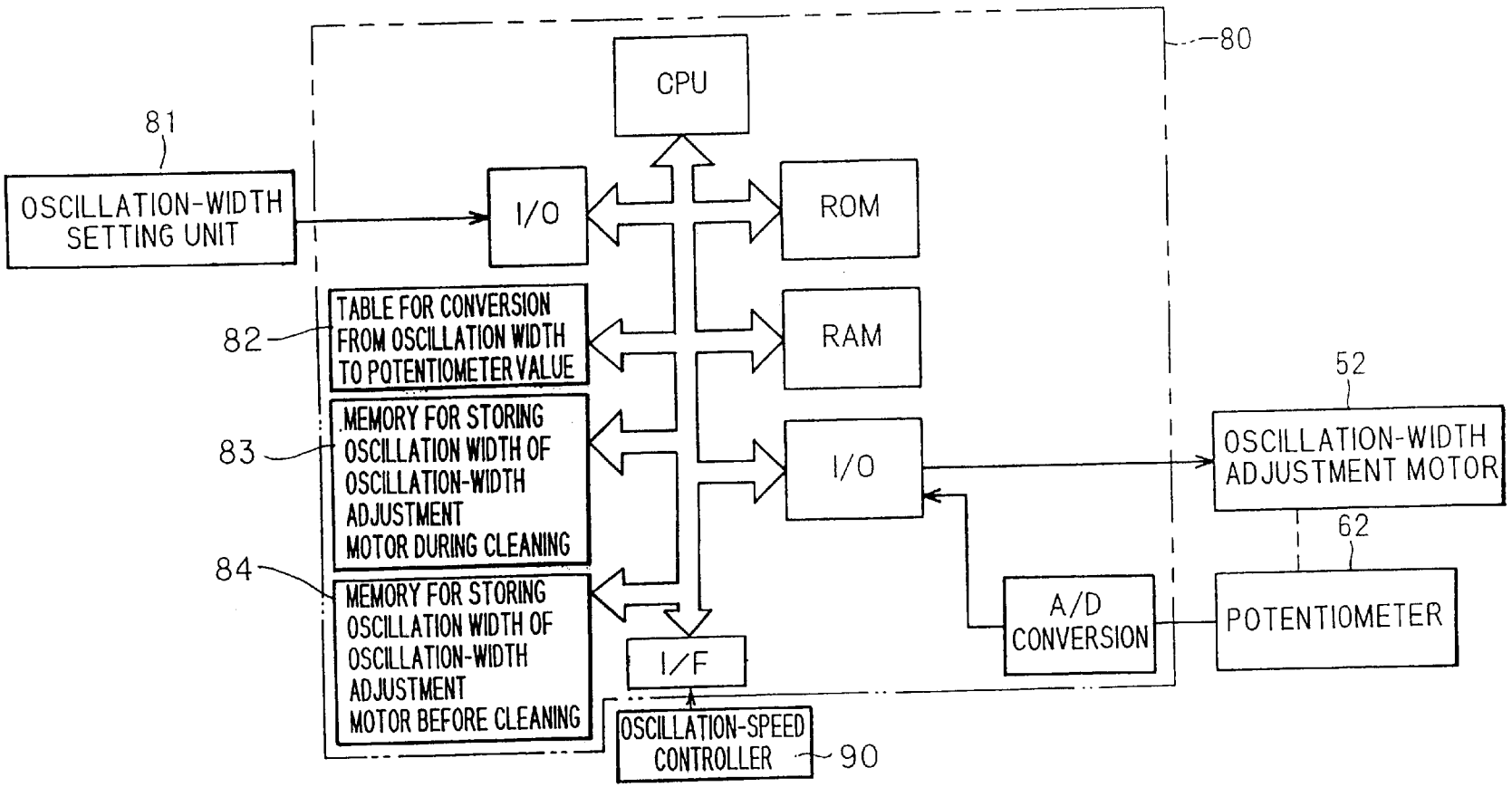
FIG. 7 is a block diagram of an oscillation-width controller.

Further, as shown in FIG. 7, the oscillation-width adjustment motor 52 and the potentiometer 62 are connected to an oscillation-width controller 80. The oscillation-width controller 80 controls the amount of rotation of the motor 52 on the basis of a signal from the potentiometer 62.

An oscillation-width setting unit 81 for inputting command signals such as an oscillation width of the oscillating roller 25*e* is connected to the oscillation-width controller 80.

The oscillation-width controller 80 includes a conversion table 82 for effecting conversion between an oscillation width set by the oscillation-width setting unit 81 and a value detected by the potentiometer 62.

Accordingly, the oscillation width set by the oscillation-width setting unit 81 is converted to a target value by the conversion table 82; and the oscillation-width adjustment motor 52 is driven such that the value detected by the potentiometer 62 becomes equal to the target value.

Moreover, the oscillation-width controller 80 includes an oscillation width memory 83 for storing an oscillation width of the oscillation-width adjustment motor 52 at the time of cleaning and an oscillation width memory 84 for storing an oscillation width of the oscillation-width adjustment motor 52 before the cleaning.

A most preferable value for the oscillation width of the oscillating rollers 25*e* at the time of cleaning, generally the maximum oscillation width, is stored in the oscillation width memory 83 in advance.

At the time of cleaning, the maximum oscillation width is read out of the oscillation width memory 83 and is set for the oscillation-width adjustment motor 52, as will be described later.

An oscillation width of the oscillation-width adjustment motor 52 before cleaning; i.e., an oscillation width of the oscillation-width adjustment motor 52 for ordinary rainbow printing, is stored in the oscillation width memory 84.

The oscillation width for ordinary rainbow printing is read out of the oscillation width memory 84 after completion of the cleaning, as will be described later.

Figure 8:
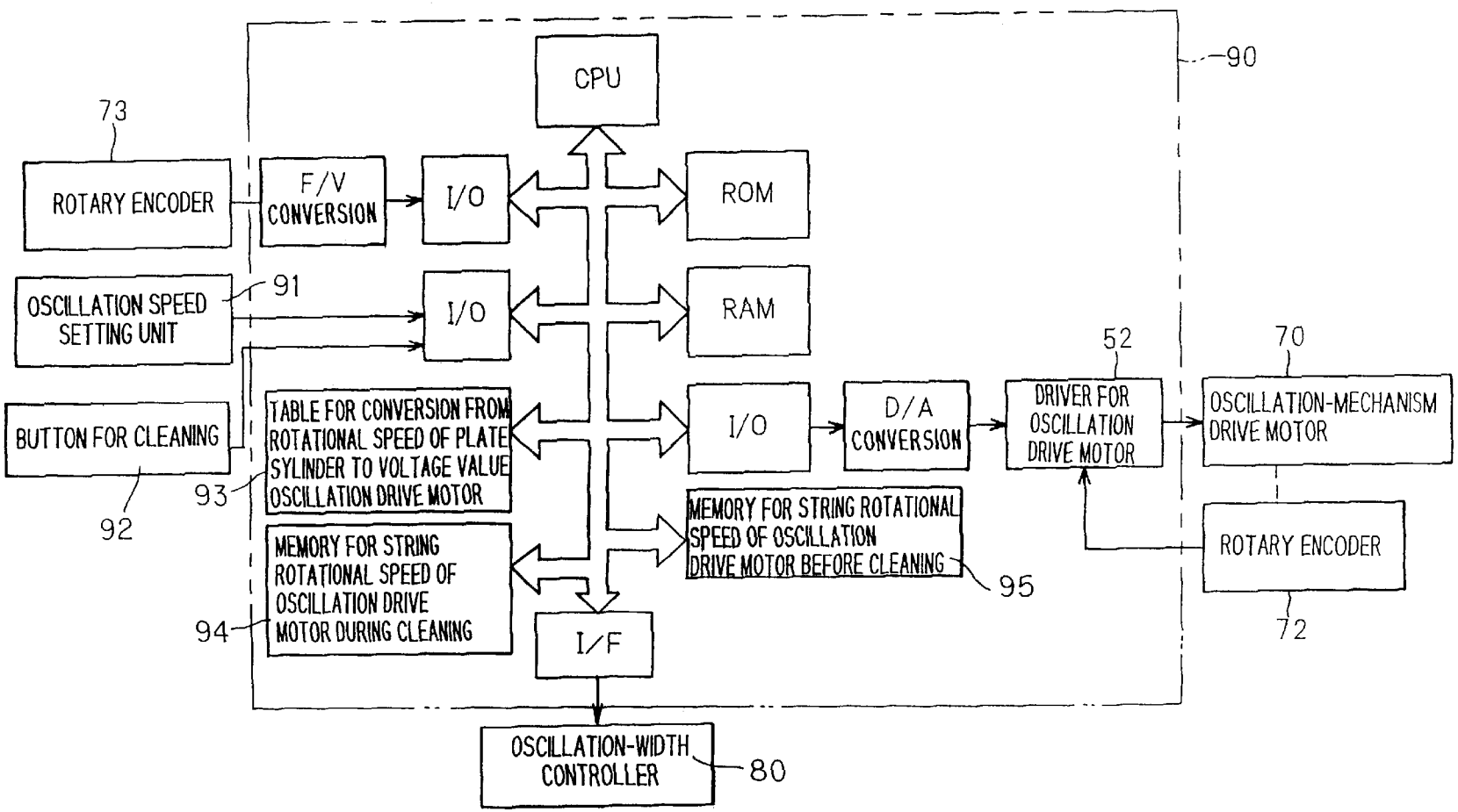
FIG. 8 is a block diagram of an oscillation-speed controller.

Meanwhile, as shown in FIG. 8, the oscillation-mechanism drive motor 70 and a rotary encoder 72 connected to the motor 70 are connected to an oscillation-speed controller 90. The oscillation-speed controller 90 controls the motor 70 while checking the rotational speed of the motor 70 on the basis of a signal from the rotary encoder 72.

A rotary encoder 73 for detecting the rotational speed of the transfer cylinder 21*a*; i.e., the rotational speed of the plate cylinders 23*a* and 23*b*, and an oscillation speed setting unit 91 for inputting command signals such as the oscillation speed of the oscillating roller 25*e* corresponding to the rotational speed of the plate cylinders 23*a* and 23*b* are connected to the oscillation-speed controller 90.

Accordingly, the oscillation-speed controller 90 controls the oscillation-mechanism drive motor 70 on the basis of a signal from the rotary encoder 73, while checking the signal from the rotary encoder 72, such that the oscillation speed of the oscillating roller 25*e* becomes equal to the value input and designated by the oscillation speed setting unit 91.

Further, the oscillation-speed controller 90 includes a conversion table 93 for effecting conversion between rotational speed of the plate cylinders 23*a* and 23*b* detected by the rotary encoder 73 and voltage value of the oscillation-mechanism drive motor 70.

Moreover, the oscillation-speed controller 90 includes an automatic cleaning button 92, a rotational speed memory 94 for storing a rotational speed of the oscillation-mechanism drive motor 70 at the time of cleaning and a rotational speed memory 95 for storing a rotational speed of the oscillation-mechanism drive motor 70 before performance of cleaning.

Figure 13:
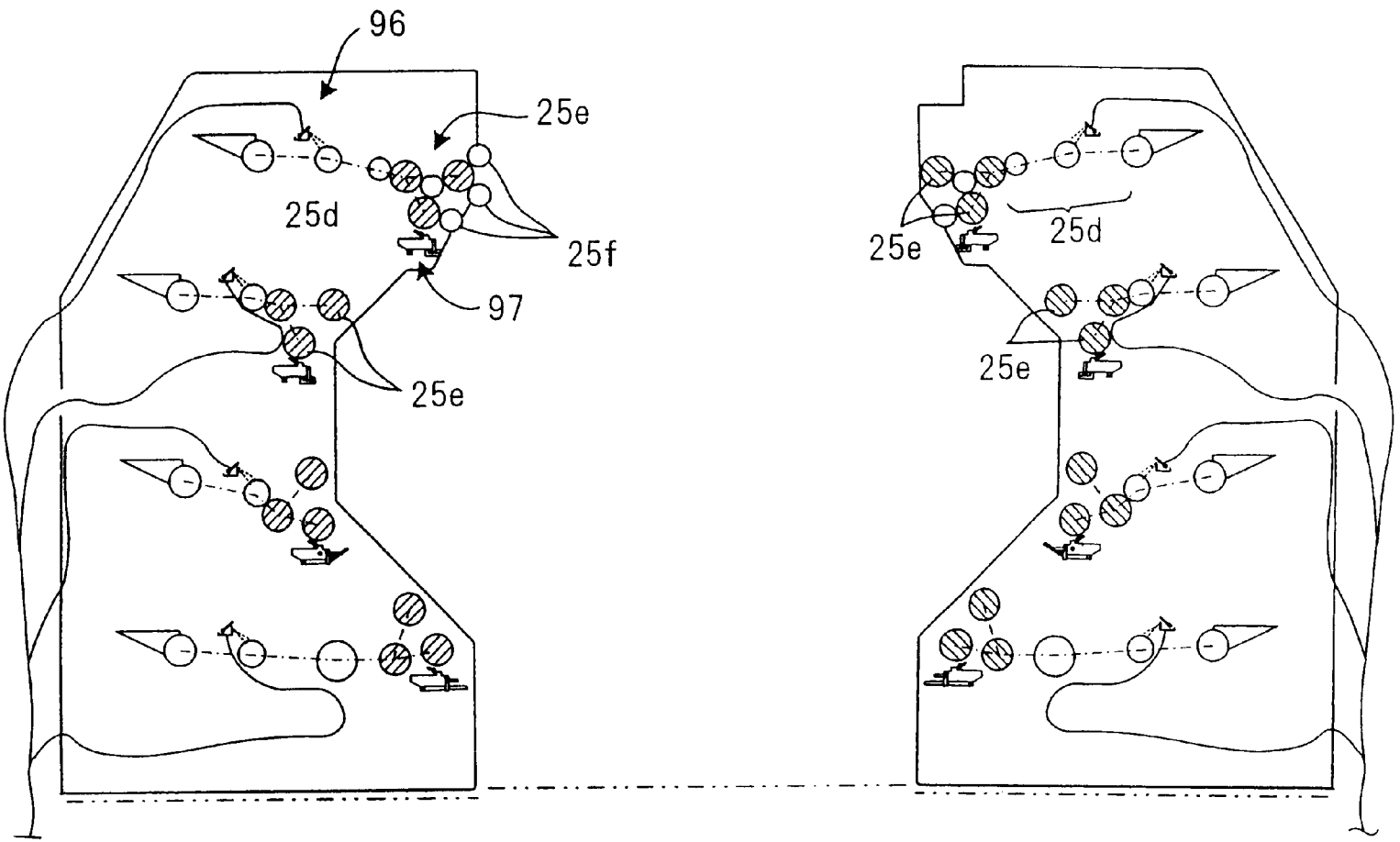
FIG. 13 is an explanatory view showing an inker cleaning work.

When the automatic cleaning button 92 is operated, as shown in FIG. 13, a cleaning solution is jetted from a plurality of cleaning-solution jetting nozzles 96 toward the distribution rollers 25*d*. Thus, the distribution rollers 25*d* are cleaned, and the cleaning solution is collected by drain receivers (cleaning doctors) 97 via the oscillating rollers 25*e*.

It is to be noted that the oscillation-width adjustment motor 52 may be controlled such that the oscillation width and oscillation speed of the oscillating rollers 25*e* become maximum in response to operation of the automatic cleaning button 92.

The most preferable value for the rotational speed of the oscillation-mechanism drive motor 70 at the time of cleaning, generally the maximum rotational speed, is stored in the rotational speed memory 94 in advance.

At the time of cleaning, the maximum rotational speed is read out of the rotational speed memory 94 and is set for the oscillation-mechanism drive motor 70, as will be described later.

A rotational speed of the oscillation-mechanism drive motor 70 before cleaning; i.e., a rotational speed of the oscillation-mechanism drive motor 70 for ordinary printing, is stored in the rotational speed memory 95.

After completion of the cleaning, the rotational speed for ordinary printing is read out of the rotational speed memory 95 and is set for the oscillation-mechanism drive motor 70, as will be described later.

As shown in FIGS. 7 and 8, the oscillation-width controller 80 and the oscillation-speed controller 90 are connected to each other, and the oscillation-width controller 80 drives the oscillation-width adjustment motor 52 after checking the drive state of the oscillation-mechanism drive motor 70 via the oscillation-speed controller 90.

In the present embodiment, a crank mechanism is constituted by the support shaft 64, the transmission gear 65, the rotary drum 66, the universal joint 67, the shaft 68, the universal joint 69, etc.; an oscillation mechanism is constituted by the clank mechanism, the support base 41, the support pin 42, the swing levers 43, the slide lever 44, the pin 45, the first link plate 46, the support pin 47, the swing plate 48, the pin 49, the cam follower 50, etc.; an oscillation-width adjustment mechanism is constituted by the support base 41, the drive gear 54, the transmission gear 55, the drive shaft 56, the worm gear 57, the worm wheel 58, the transmission shaft 59, the second link plate 60, the pin 61, the slide lever 44, etc.; oscillation width control means is constituted by the gears 53 and 63, the potentiometer 62, the oscillation-width controller 80, the oscillation-width setting unit 81, etc.; and oscillation speed control means is constituted by the rotary encoders 72 and 73, the oscillation-speed controller 90, the oscillation speed setting unit 91, etc.

In the double-sided, multicolor offset press equipped with the above-described oscillation apparatus for the oscillating roller 25*e*, when the paper sheet 1 is transferred from the sheet-feed table 11 of the feeder unit 10 to the transfer cylinder 21*a* via the feeder board 12 and the swing apparatus 13, the paper sheet 1 is transferred to the impression cylinder 22*a* (having unillustrated grippers) of the printing unit 20 via the transfer cylinders 21*b* to 21*d* and passes through the space between the impression cylinder 22*a* and the rubber cylinder 22*b*.

At this time, ink from the inker 25 is supplied to each of the plates attached to the plate cylinders 23*a* and 23*b*. As a result, ink held on the plate of each plate cylinder 23*a* at portions corresponding to an image thereof is supplied to the blanket at the outer circumferential surface of the impression cylinder 22*a*, and ink held on the plate of each plate cylinder 23*b* at portions corresponding to an image thereof is supplied to the blanket at the outer circumferential surface of the rubber cylinder 22*b*. Therefore, as the paper sheet 1 passes through the space between the cylinders 22*a* and 22*b*, the image of the impression cylinder 22*a* is transferred onto one face of the paper sheet 1 and the image of the rubber cylinder 22*b* is transferred onto the other face of the paper sheet 1.

The paper sheet 1 having undergone double-sided, multicolor printing is transferred to the delivery cylinder 31 via the transfer cylinder 24. Subsequently, after having been gripped by the grippers of the delivery chain 33, the paper sheet 1 is conveyed to the delivery tables 35*a* and 35*b* and is then delivered.

When ink is supplied from the inker 25 to the plate cylinders 23*a* and 23*b* in the above-described manner, the oscillation width and oscillation speed of the oscillating roller 25*e* are adjusted as follows.

Oscillation-width Adjustment

Figure 9:
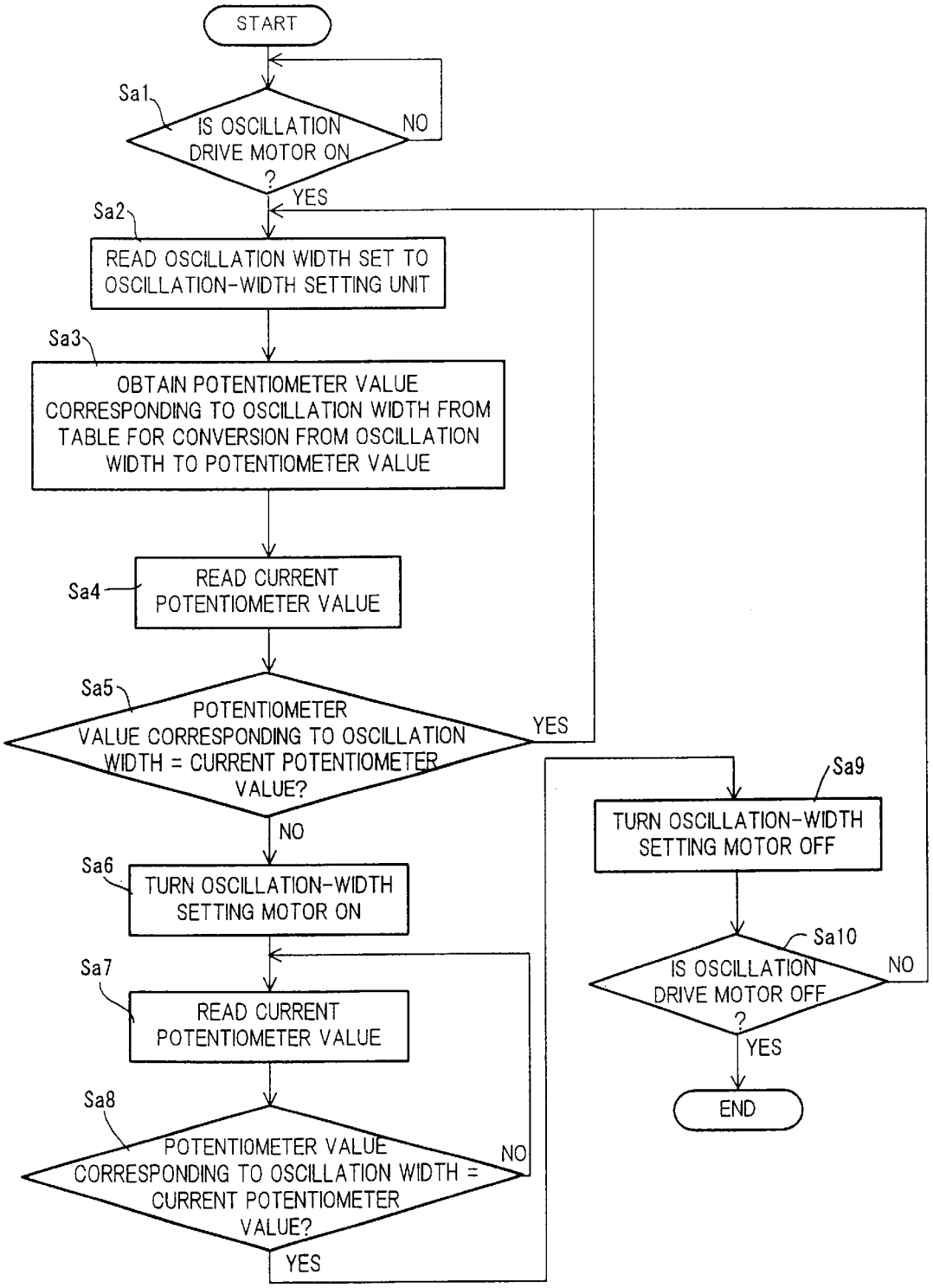
FIG. 9 is a flowchart for an oscillation-width control.

When an oscillation width of the oscillating roller 25*e* is input to the oscillation-width setting unit 81, as shown in FIG. 9, the oscillation-width controller 80 first checks whether the oscillation-mechanism drive motor 70 is being operated, on the basis of the signal from the oscillation-speed controller 90 (step Sa1).

When the oscillation-mechanism drive motor 70 is stopped, the oscillation-width controller 80 waits, without proceeding to the next step, until the oscillation-mechanism drive motor 70 starts its operation. When the oscillation-mechanism drive motor 70 is operating, the oscillation-width controller 80 proceeds to the next step.

This is because if the oscillating roller 25*e* is operated while the various rollers 25*a* to 25*g* of the inker 25 are stopped, the roller surface may be damaged due to friction therebetween.

Next, the oscillation-width controller 80 reads the oscillation width input from the oscillation-width setting unit 81 (step Sa2), and obtains a value of the potentiometer 62 corresponding to the input oscillation width, on the basis of a conversion table which defines the relationship between oscillation width of the oscillating roller 25*e* (the distance between the pins 42 and 45) and value of the potentiometer 62 (step Sa3). Subsequently, the oscillation-width controller 80 reads the current value of the potentiometer 62 (step Sa4) and checks whether the read value of the potentiometer 62 is equal to the value obtained in the above-described step Sa3 (step Sa5). When these values are equal to each other, the oscillation-width controller 80 returns to the above-described step Sa2 (the current status is maintained). When these values are not equal to each other, the oscillation-width controller 80 proceeds to the next step.

When the above-described two values are not equal to each other, the oscillation-width controller 80 operates the oscillation-width adjustment motor 52 (step Sa6), reads the present value of the potentiometer 62 (step Sa7), and checks whether the read value of the potentiometer 62 is equal to the value obtained in the above-described step Sa3 (step Sa8). When these values are not equal to each other, the oscillation-width controller 80 repeats the above-described steps Sa6 to Sa8 until these values become equal to each other. When the values becomes equal to each other, the oscillation-width controller 80 proceeds to the next step.

When the above-described two values become equal to each other, the oscillation-width controller 80 stops the operation of the oscillation-width adjustment motor 52 (step Sa9), and checks whether the oscillation-mechanism drive motor 70 is being operated (step Sa10). When the oscillation-mechanism drive motor 70 is operating, the oscillation-width controller 80 returns to the above-described step Sa2. When the oscillation-mechanism drive motor 70 is stopped, the oscillation-width controller 80 ends the control.

Through this operation, the distance between the pins 42 and 45 is set via the drive gear 54, the transmission gear 55, the drive shaft 56, the worm gear 57, the worm wheel 58, the transmission shaft 59, the second link plate 60, the pin 61, and the slide lever 44.

Oscillation-speed Adjustment

Figure 10:
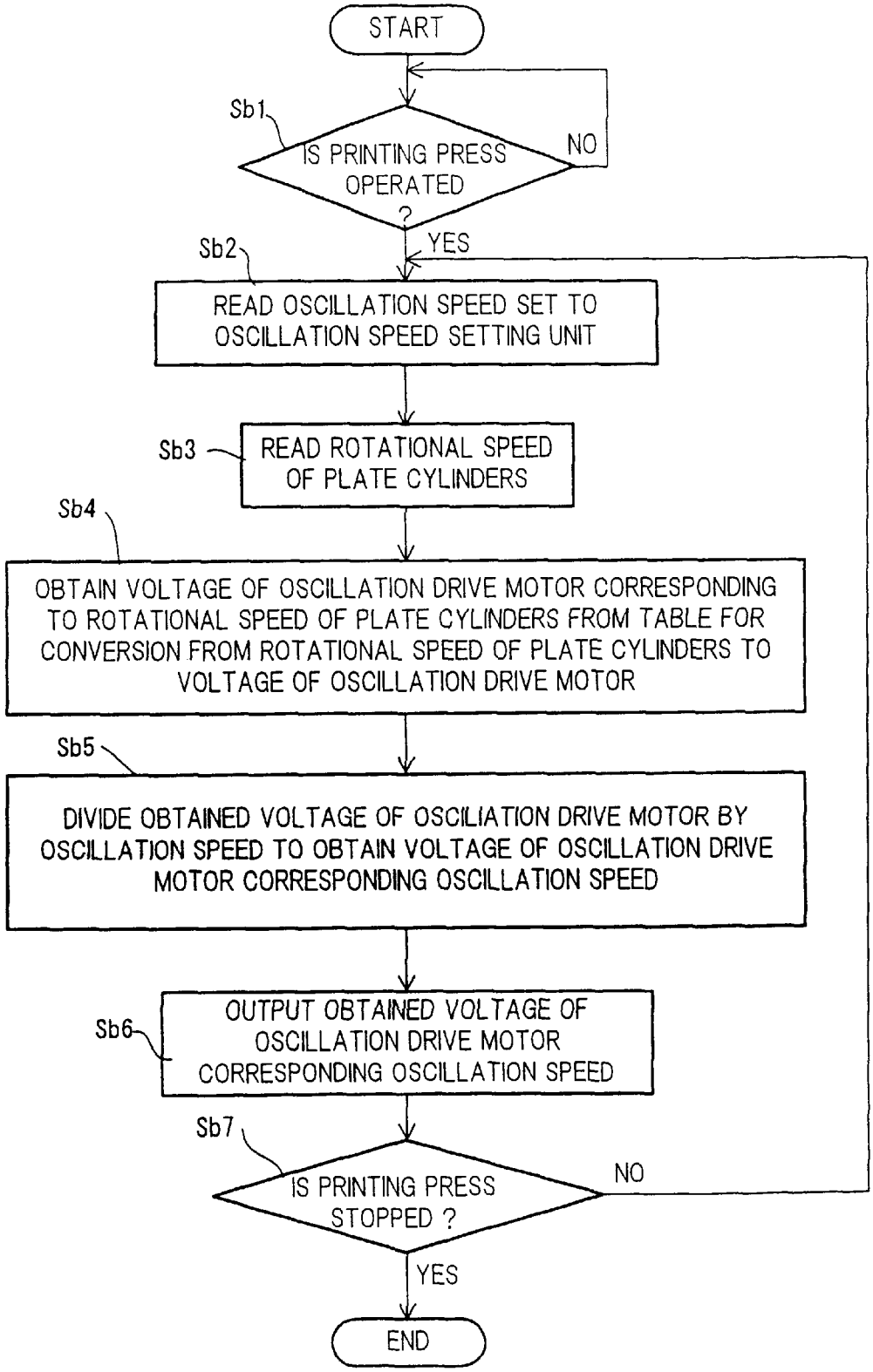
FIG. 10 is a flowchart for an oscillation speed control.

When an oscillation speed of the oscillating roller 25*e* (the number of revolutions of the plate cylinders 23*a* and 23*b* during each round of reciprocating travel of the oscillating roller 25*e*) is input through the oscillation speed setting unit 91, as shown in FIG. 10, the oscillation-speed controller 90 first checks whether the transfer cylinder 21*a* is being rotated; i.e., whether the printing press is being operated, on the basis of the signal from the rotary encoder 73 (step Sb1).

When the printing press is not being operated, the oscillation-speed controller 90 waits, without proceeding to the next step, until the printing press is started. When the printing press is operating, the oscillation-speed controller 90 proceeds to the next step. This is because if the oscillating roller 25*e* is operated while the various rollers 25*a* to 25*g* of the inker 25 are stopped, the roller surface may be damaged due to friction therebetween.

Next, the oscillation-speed controller 90 reads the oscillation speed input from the oscillation speed setting unit 91 (step Sb2), reads the rotational speed of the transfer cylinder 21*a*; i.e., the rotational speed of the plate cylinders 23*a* and 23*b* from the rotary encoder 73 (step Sb3), and obtains a voltage value of the oscillation-mechanism drive motor 70 corresponding to the rotational speed of the plate cylinders 23*a* and 23*b*, on the basis of a conversion table which defines the relationship between rotational speed of the plate cylinders 23*a* and 23*b* and voltage value of the oscillation-mechanism drive motor 70 (step Sb4). Subsequently, the thus-obtained voltage value is divided by the input oscillation speed to thereby obtain the voltage value of the oscillation-mechanism drive motor 70 corresponding to the oscillation speed (step Sb5). Subsequently, the oscillation-speed controller 90 drives and controls the motor 70 in accordance with the voltage value (step Sb6).

Subsequently, the oscillation-speed controller 90 checks whether the printing press is being operated (step Sb7). When the printing press is operating, the oscillation-speed controller 90 returns to the above-described step Sb2. When the printing press is stopped, the oscillation-speed controller 90 ends the control. Through this operation, the pin 45 is moved via the drive gear 71, the transmission gear 65, the support shaft 64, the rotary drum 66, the universal joint 67, the shaft 68, the universal joint 69, and the swing levers 43 such that the pin 45 reciprocatively revolves about the support pin 42 with a period which always corresponds to the rotational period of the plate cylinders 23*a* and 23*b*. Consequently, the swing plate 48 is moved via the first link plate 46 and the support pin 47 such that the swing plate 48 swings about the pin 49 with a period which always corresponds to the rotational period of the plate cylinders 23*a* and 23*b*. Thus, via the cam follower 50 inserted into the groove wheel 25*ea*, the oscillating roller 25*e* reciprocates a plurality of number of times which always corresponds to the rotational period of the plate cylinders 23*a* and 23*b*.

Therefore, the above-described oscillation apparatus has the following advantages. (1) Since the oscillation width of the oscillating roller 25*e* is adjusted through control of the rotational amount of the oscillation-width adjustment motor 52, and the oscillation speed of the oscillating roller 25*e* is adjusted through control of the rotational speed of the oscillation-mechanism drive motor 70, the control mechanism for the oscillating roller 25*e* can be simplified. (2) Since the state of oscillation of the oscillating roller 25*e* is controlled by the above-described motors 52 and 70, the oscillating roller 25*e* can be operated with high responsiveness, and the oscillation of the oscillating roller 25*e* can be adjusted finely and easily.

Accordingly, the above-described oscillation apparatus enables the oscillation state of the oscillating roller 25*e* to be adjusted with high responsiveness by use of a simple mechanism.

Figure 11:
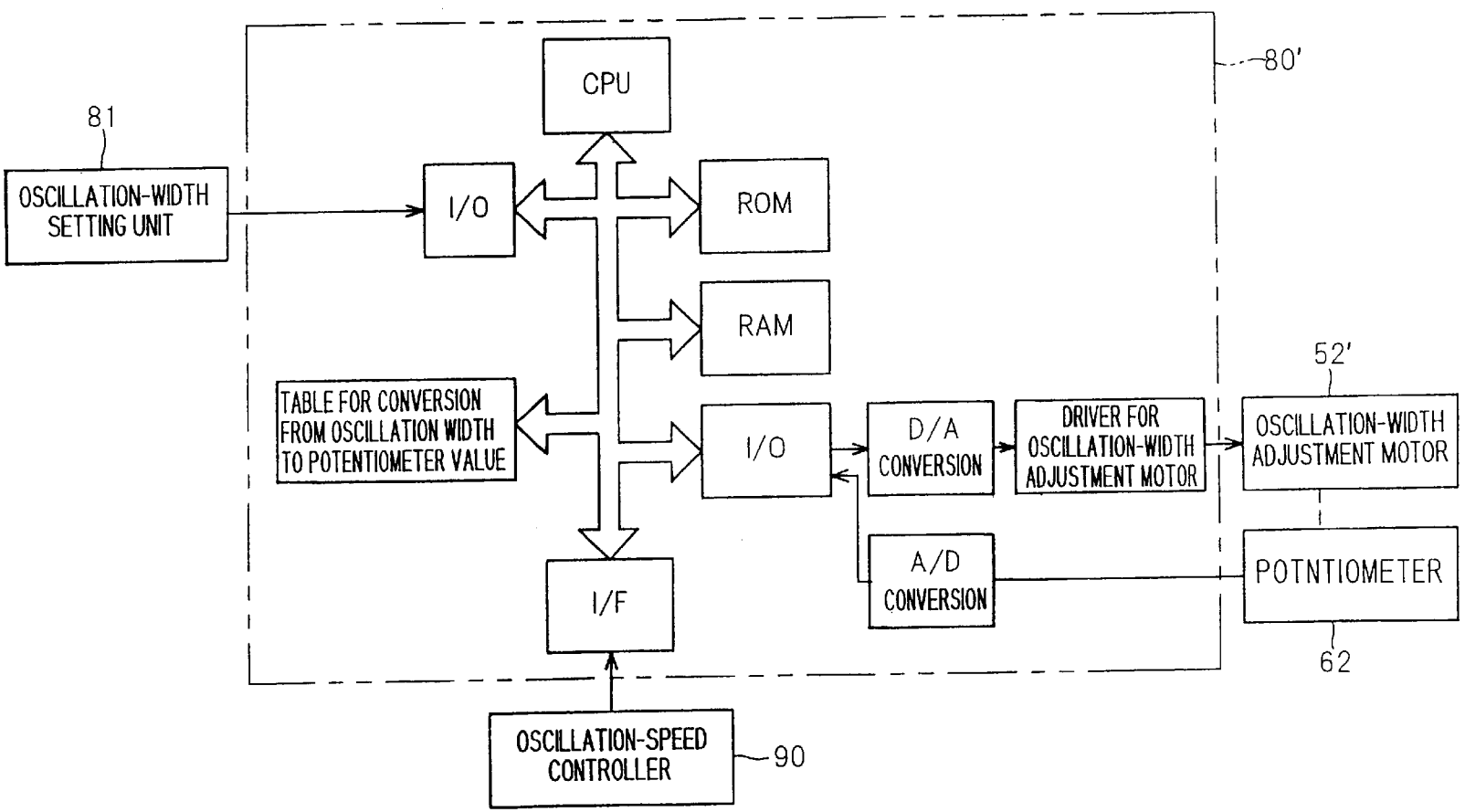
FIG. 11 is a block diagram of another example of the oscillation-width controller.

When an induction motor is used for the oscillation-width adjustment motor 52, as shown in FIG. 7, the oscillation-width controller 80 is not required to have a driver for the motor 52. However, when an oscillation-width adjustment motor 52' composed of an ordinary servomotor is employed as shown in FIG. 11, an oscillation-width controller 80' having a driver for the motor 52' is used.

Sole Drive of Inker

In the printing press having the above-described configuration, at the time of cleaning work or maintenance, the inker 25 can be driven solely by use of the oscillation-mechanism drive motor 70.

That is, as indicated by the two-dot chain line in FIG. 1A, the inker 25 is separated from the main unit, and electricity is supplied to the electromagnetic clutch 120 in order to establish a mechanical connection between the oscillation-mechanism drive motor 70 and the distribution rollers 25*d* and the oscillating rollers 25*e* via the gear train 110.

Subsequently, when the oscillation-mechanism drive motor 70 is operated, rotation of the oscillation-mechanism drive motor 70 is transmitted to the oscillating rollers 25*e* via the gear train 100, the shaft 68, and the swing plate 48, so that the oscillating rollers 25*e* reciprocate. Simultaneously, rotation of the oscillation-mechanism drive motor 70 is transmitted to one distribution roller 25*d* via the gear trains 100 and 110 and is further transmitted to the remaining distribution rollers 25*d* and the oscillating rollers 25*e* via the gear train 130, so that the plurality of distribution rollers 25*d* and the oscillating rollers 25*e* are rotated.

As described above, a cleaning work or maintenance work for the inker 25 can be performed in a state in which the plurality of distribution rollers 25*d* and the oscillating rollers 25*e* are rotated. Further, since the inker 25 is separated from the main unit, in the main unit as well, a cleaning work such as exchange of plates of the plate cylinders 23*a* can be performed simultaneously with the maintenance work for the inker 25.

Moreover, since the inker 25 is separated from the main unit, a worker can enter into a space between the rubber cylinder 22*b* and the inker 25. Therefore, maintenance such as exchange of a blanket of the rubber cylinder 22*b* can be performed.

That is, the present embodiment enables different types of maintenance to be performed at the printing unit and the inker.

The above-described electromagnetic clutch 120 and the hydraulic cylinder 26 of the inker 25 may be controlled by the control apparatus in such a manner that they are simultaneously turned on and off through an automatic operation. Alternatively, the control may be performed such that the electromagnetic clutch 120 is brought into an engaged state automatically when the inker 25 is separated from the main unit by the hydraulic cylinder 26.

Alternatively, the control may be performed such that the electromagnetic clutch 120 is brought into a disengaged state automatically during ordinary printing; i.e., in a state in which the inker 25 is connected to the main unit by the hydraulic cylinder 26.

Moreover, instead of the hydraulic cylinder 26 for moving the inker 25, the clutch 140 may be used in order to establish and break the connection between the main unit and the inker in a manner interlocked with the electromagnetic clutch 120.

As described above, in the printing press of the present embodiment, the inker 25 having the oscillation-mechanism drive motor 70 is provided with the electromagnetic clutch 120 for establishing and breaking the connection between the oscillation-mechanism drive motor 70 and the distribution rollers 25*d* and the oscillating rollers 25*e*; and the clutch 140 for establishing and breaking the connection between the inker 25 and the main unit. Therefore, during an ordinary printing, the oscillating rollers 25*e* can be reciprocated axially by means of the oscillation-mechanism drive motor 70, and during cleaning or maintenance, the oscillating rollers 25*e* and the distribution rollers 25*d* can be rotated simultaneously with the reciprocation of the oscillating rollers 25*e*.

Therefore, disposition of a motor for solely driving the inker becomes unnecessary, so that the number of motors disposed for each inking unit for a single color can be reduced, and thus cost and size can be reduced.

Automatic Modification of Oscillation Width and Oscillation Speed during Cleaning Work Moreover, in order to enable cleaning work to be performed efficiently, during the cleaning, the oscillation width and oscillation speed of the oscillating rollers 25*e* are changed automatically in the manner described below, in accordance with the flowchart shown in FIG. 14.

First, a judgment is made as to whether conditions for sole drive of the inker 25 are satisfied, i.e., whether the state in which the inker 25 is separated from the main unit and the state in which the oscillation-mechanism drive motor 70 is mechanically connected to the distribution rollers 25*d* and the oscillating rollers 25*e*, via the gear train 110 are both established (step Sc1).

When the conditions for the sole drive of the inker are satisfied, the oscillation-mechanism drive motor 70 is operated in order to transmit its rotation to the oscillating rollers 25*e* via the gear train 100 and other components to thereby reciprocate the oscillating rollers 25*e*, and to transmit the rotation to one distribution roller 25*d* via the gear trains 100 and 110 and transmit the rotation further to the remaining distribution rollers 25*d* and the oscillating rollers 25*e* to thereby rotate the distribution rollers 25*d* and the oscillating rollers 25 (step Sc2).

Subsequently, when the automatic cleaning button 92 is operated, as shown in FIG. 13, the cleaning solution is jetted from the plurality of cleaning-solution jetting nozzles 96 toward the distribution rollers 25*d*. Thus, the distribution rollers 25*d* are cleaned, and the cleaning solution is collected by the drain receivers (cleaning doctors) 97 via the oscillating rollers 25*e* (step Sc3).

Subsequently, the oscillation width of the oscillating roller 25*e* before the cleaning; i.e., an oscillation width of the oscillating rollers 25*e* for ordinary rainbow printing, is stored in the oscillation width memory 84 (step Sc4); and the previously stored oscillation width of the oscillating rollers 25*e* at the time of cleaning (hereinafter referred to as the "maximum oscillation width") is read out of the oscillation width memory 83 (step Sc5).

An operation command is supplied to the oscillation-width adjustment motor 52 (step Sc6), and the oscillation width, measured by the potentiometer 62, is compared with the maximum oscillation width (step Sc7). The supply of the operation command to the oscillation-width adjustment motor 52 is continued until the oscillation width measured by the potentiometer 62 becomes equal to the maximum oscillation width (step Sc8).

The oscillation-width adjustment motor 52 is stopped after the oscillation width, measured by the potentiometer 62, has become equal to the maximum oscillation width (step Sc9).

Since the cleaning of the inker 25 is performed while the oscillating rollers 25*e* are rotated and oscillated over the maximum oscillation width, the inker 25 is cleaned more efficiently as compared to the case in which the oscillating rollers 25*e* are oscillated over the oscillation width for ordinary printing.

After completion of the cleaning of the inker 25 (step Sc10), the previously stored oscillation width for ordinary printing is read out of the oscillation width memory 84 (step Sc11). Subsequently, an operation command is supplied to the oscillation-width adjustment motor 52 (step Sc12), and the oscillation width measured by the potentiometer 62 is compared with the oscillation width read out of the oscillation-width memory 84 (step Sc13). The supply of the operation command to the oscillation-width adjustment motor 52 is continued until the oscillation width measured by the potentiometer 62 becomes equal to the oscillation width read out of the oscillation-width memory 84 (step Sc14). The oscillation-width adjustment motor 52 is stopped after the oscillation width measured by the potentiometer 62 has become equal to the oscillation width read out of the oscillation-width memory 84 (step Sc15).

After completion of the cleaning of the inker 25, the operation conditions are automatically changed such that the oscillation width of the oscillating rollers 25*e* is reset to the value before the cleaning. Therefore, when the same printing material as that printed before the cleaning is printed, re-adjustment becomes unnecessary.

Figure 14:
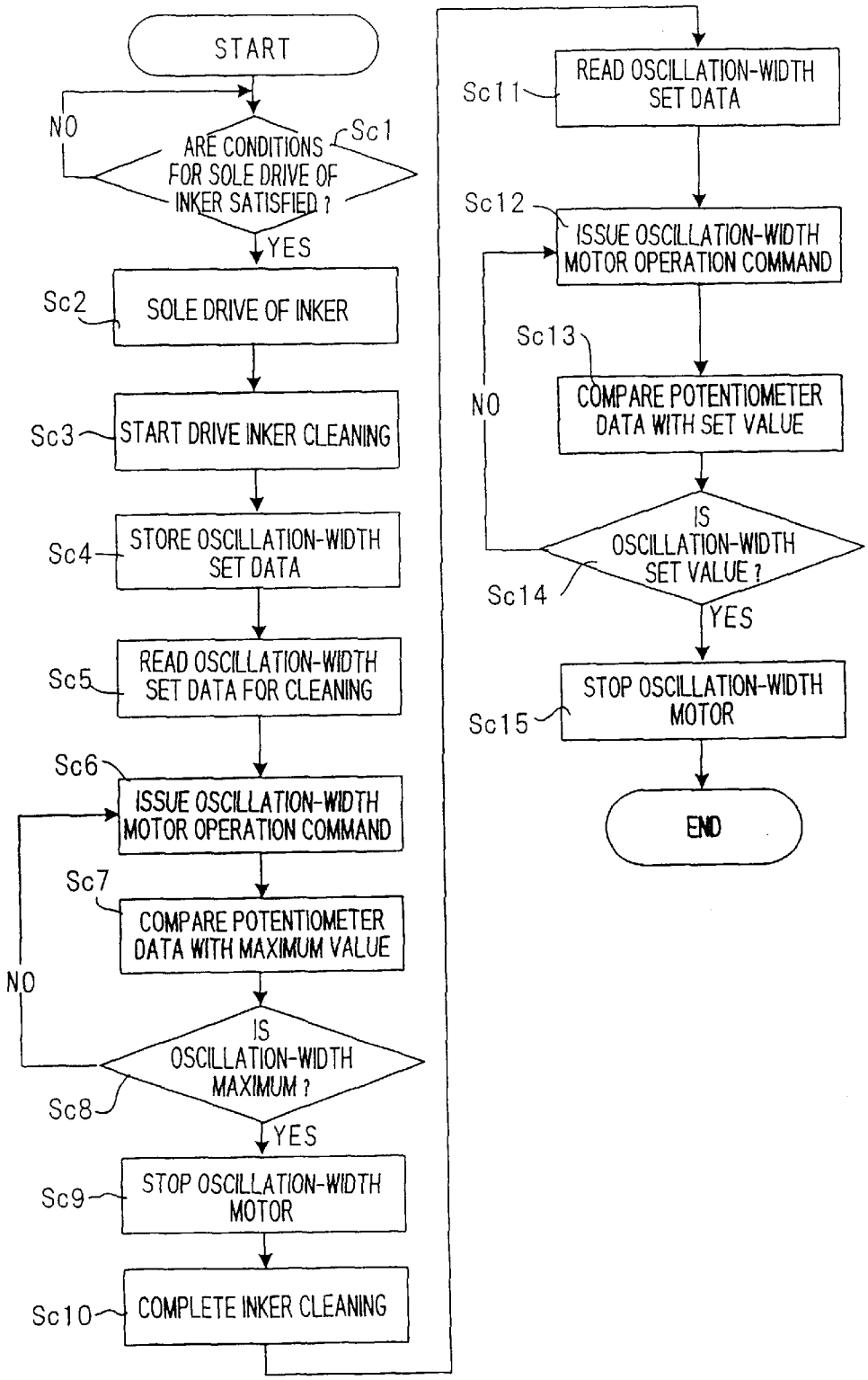
FIG. 14 is a flowchart for automatically modifying oscillation width at the time of cleaning work.

Although the flowchart shown in FIG. 14 is for automatic modification of the oscillation width of the oscillating rollers 25*e*, the oscillation speed of the oscillating rollers 25*e* can be modified in a similar manner.

That is, the flowchart is modified through replacement of "oscillation width" in steps Sc4 to Sc14 with "oscillation speed" and replacement of "oscillation-width adjustment motor 52" with "oscillation-mechanism drive motor 70"; and the oscillation width memories 83 and 84 are replaced with rotational speed memories 94 and 95. Thus, the cleaning of the inker 25 is performed, while the oscillating rollers 25*e* are rotated at a preset maximum rotational speed; and after completion of the cleaning of the inker 25, the operation conditions are changed automatically such that the oscillation speed of the oscillating rollers 25*e* is reset to the value before the cleaning.

Therefore, the inker 25 is cleaned more efficiently as compared to the case in which the oscillating rollers 25*e* are oscillated at the oscillation speed for ordinary printing, so that the cleaning time can be shortened. It is to be noted that the cleaning of the inker may be performed in a state in which the oscillating rollers 25*e* are rotated at a rotational speed lower than the maximum rotational speed.

When printing is resumed after completion of the cleaning, the oscillation speed is reset to the original value. Therefore, when the same printing material as that printed before the cleaning is printed, re-adjustment becomes unnecessary.

It is to be noted that since the load of oscillation drive decreases during the cleaning of the ink rollers, no problem occurs even when the oscillation speed is increased.

As described above, the operation conditions are automatically modified in response to the operation of the automatic cleaning button 92 such that the oscillation width and oscillation speed of the oscillating rollers 25*e* are maximized, the inker can be cleaned efficiently. In addition, since the oscillation width and oscillation speed of the oscillating rollers 25*e* are reset to the original values after completion of the cleaning work, re-adjustment becomes unnecessary.

As having been described specifically on the basis of the embodiments, in the present invention, set values such as oscillation width and oscillation speed of the oscillating rollers can be modified automatically at the time of cleaning or other work for an ink supply apparatus. Therefore, the cleaning work and other related works can be performed efficiently.

In addition, since the oscillation width and oscillation speed of the oscillating rollers 25*e* are reset to the original values after completion of the cleaning, re-adjustment becomes unnecessary, and ordinary printing is not hindered.

Obviously, numerous modifications and variations of the present invention are possible in light of the above teachings. It is, therefore, to be understood that within the scope of the appended claims, the present invention may be practiced otherwise than as specifically described herein.

What is claimed is:

1. An inking apparatus control means for a rotary press, the rotary press having a plate cylinder, comprising:

an oscillating roller rotatable in a circumferential direction and reciprocatable along an axial direction thereof; and control means for controlling at least one of an oscillation width of said oscillating roller and a number of times of oscillations of said oscillating roller relative to a number of revolutions of the plate cylinder, said control means controlling said at least one of the oscillation width and the number of times of oscillations based on a designated value, and said control means adapted to hold a target value used during a cleaning work in order to control said at least one of the oscillation width and the number of times of oscillations, and changing said at least one of the oscillation width and the number of times of oscillations to coincide with the held target value during the cleaning work.

2. An inking apparatus control means for a rotary press according to claim 1, further comprising:

an oscillation-width adjustment mechanism for adjusting an oscillation width of said oscillating roller; and oscillation-width adjustment means for operating said oscillation-width adjustment mechanism, wherein said control means controls operation of said oscillation-width adjustment means such that the oscillation width of said oscillating roller assumes a designated value such that said oscillating roller oscillates over a preset oscillation width during the cleaning work.

3. An inking apparatus control means for a rotary press according to claim 1, further comprising:

an oscillation mechanism for reciprocating said oscillating roller; and oscillation-mechanism drive means for operating said oscillation mechanism, wherein said control means controls operation of said oscillation-mechanism drive means, on the basis of the number of revolutions of the plate cylinder, such that the number of times of oscillations of said oscillating roller relative to the number of revolutions of the plate cylinder assumes a designated value and such that the number of times of oscillations of said oscillating roller assume a predetermined value during the cleaning work.

4. An inking apparatus control means for a rotary press according to claim 2 or 3, wherein said control means rotates said oscillating roller at a preset number of revolutions.

5. An inking apparatus control means for a rotary press according to claim 4, wherein said oscillation mechanism drive means rotates said oscillating roller at least during the cleaning work.

6. An inking apparatus control means for a rotary press according to claim 5, further comprising:

a clutch for permitting and stopping transmission of rotation from said oscillation mechanism drive means to said oscillating roller.

7. An inking apparatus control means for a rotary press according to claim 6, further comprising:

a main motor for rotating said plate cylinder and said oscillating roller; and connecting/disconnecting means for stopping and permitting transmission of rotation from said main motor to said oscillating roller, wherein said clutch is brought into connected and disconnected states in such a manner that transmission of rotation from said oscillation-mechanism drive means to said oscillating roller is stopped when rotation is transmitted from said main motor to said oscillating roller by said connecting/disconnecting means and that rotation is transmitted from said oscillation-mechanism drive means to said oscillating roller when transmission of rotation from said main motor to said oscillating roller is stopped by said connecting/disconnecting means.

8. An inking apparatus control means for a rotary press according to claim 2, further comprising:

a switch for starting the cleaning work, wherein in response to an operation of said switch, said control means controls said oscillation-width adjustment means such that said oscillating roller oscillates over a preset oscillation width.

9. An inking apparatus control means for a rotary press according to claim 3, further comprising:

a switch for starting the cleaning work, wherein in response to an operation of said switch, said control means controls said oscillation-mechanism drive means such that the number of times of oscillations of said oscillating roller assumes a preset value.

10. An inking apparatus control means for a rotary press according to claim 1, further comprising:

a cleaning apparatus for cleaning said oscillating roller and a distribution roller supported to be rotatable in a circumferential direction and unmovable in an axial direction;

setting means for setting conditions as the target value such that at least one of the oscillation width and the number of times of oscillations of said oscillating roller increases at the beginning of the cleaning; and a memory for storing at least one of a set value for the oscillation width and a set value for the number of times of oscillations of said oscillating roller, which set value is used before the setting is performed by setting means, wherein upon completion of the cleaning, the set value is read out of said memory as the designated value, and one of the oscillation width and the number of times of oscillations are reset to the original values used before performance of the cleaning.

11. An inking apparatus control means for a rotary press according to claim 10, wherein said setting means sets one of the oscillation width and the number of times of oscillations of said oscillating roller to a maximum value.

12. An inking apparatus control means for a rotary press according to claim 10, wherein said control means causes said oscillation-mechanism drive means to operate at a higher speed.

13. An inking apparatus control means for a rotary press according to claim 1, wherein said cleaning work is performed in a space formed as a result of separating a first frame which supports the plate cylinder and a second frame which supports said oscillating roller.

14. An inking apparatus control means for a rotary press according to claim 1, further comprising:

an oscillation mechanism for reciprocating said oscillating roller;

an oscillation-mechanism drive means for operating said oscillation mechanism;

an oscillation-width adjustment mechanism for adjusting an oscillation width of said oscillating roller; and oscillation-width adjustment means for operating said oscillation-width adjustment mechanism.

15. An inking apparatus control means according to claim 14, wherein said oscillation mechanism includes, a swing member which swings upon operation of said oscillation-mechanism drive means, a moving member movably supported on said swing member, and an engagement member rotatably supported on said moving member and being in engagement with said oscillating roller, and wherein said oscillation-width adjustment mechanism is configured such that, upon operation of said oscillation-width adjustment means, said oscillation-width adjustment mechanism moves said moving member to thereby adjust a distance between a swing center of said swing member and a rotation center of said engagement member.

16. An inking apparatus control means according to claim 15, wherein said moving member is slidably supported on said swing member.

17. An inking apparatus according to claim 14, wherein said oscillation mechanism includes, a crank mechanism whose input side is connected to said oscillation-mechanism drive means, a swingably-supported swing lever whose base end side is connected to the output side of said crank mechanism, a slide lever slidably supported by said swing lever such that the distal end side of said slide lever can move toward and away from a swing center of said swing lever, a first link plate whose one end side is rotatably supported by the distal end side of said slide lever, a swingably-supported swing plate, the other end side of said first link plate being rotatably connected to the base end side of said swing plate, a groove wheel provided in said oscillating roller, and a cam follower provided at the distal end side of said swing plate and inserted into the groove wheel, and wherein said oscillation-width adjustment mechanism includes, a worm gear connected to said oscillation-width adjustment means, a worm wheel in meshing engagement with said worm gear, a transmission shaft coaxially connected to said worm wheel, a second link plate whose one end side is connected to said transmission shaft, and said slide lever whose base end side is rotatably connected to the other end side of said second link plate.

18. An inking apparatus control means according to claim 1, wherein said designated value is used to control said at least one of the oscillation width and the number of times of oscillations at least one of prior and after the cleaning work.

* * * * *